US008801325B1

(12) United States Patent
Garland et al.

(10) Patent No.: US 8,801,325 B1
(45) Date of Patent: Aug. 12, 2014

(54) SYSTEM AND METHOD FOR CONTROLLING AN ASPHALT REPAIR APPARATUS

(71) Applicants: Stephen Douglas Garland, Denver, CO (US); Edmond Joseph Limoge, Williston, VT (US); William Petrow, Charlotte, VT (US); John Edward Cronin, Jericho, VT (US)

(72) Inventors: Stephen Douglas Garland, Denver, CO (US); Edmond Joseph Limoge, Williston, VT (US); William Petrow, Charlotte, VT (US); John Edward Cronin, Jericho, VT (US)

(73) Assignee: Heatwurx, Inc., Greenwood Village, CO (US)

( * ) Notice: Subject to any disclaimer, the term of this patent is extended or adjusted under 35 U.S.C. 154(b) by 0 days.

(21) Appl. No.: 13/777,633

(22) Filed: Feb. 26, 2013

(51) Int. Cl.
*E01C 23/14* (2006.01)

(52) U.S. Cl.
CPC ..... *E01C 23/14* (2013.01)
USPC ..... 404/77; 404/79; 404/84.05; 404/95

(58) Field of Classification Search
CPC ..... E01C 23/14; E01C 23/065; E01C 23/07
USPC ..... 404/77, 79, 84.05, 107, 109
See application file for complete search history.

(56) References Cited

U.S. PATENT DOCUMENTS

| | | | |
|---|---|---|---|
| 371,288 | A | 10/1887 | Walker |
| 1,628,874 | A | 5/1927 | Eastes |
| 2,088,534 | A | 7/1937 | Pittman |
| 2,134,245 | A | 10/1938 | Carswell |
| 2,397,782 | A | 4/1946 | Flynn |
| 2,832,187 | A | 4/1958 | Johnson |
| 2,924,054 | A | 2/1960 | Myers |
| 3,224,347 | A | 12/1965 | Seaman |
| 3,309,854 | A | 3/1967 | Mitchell et al. |
| 3,375,764 | A | 4/1968 | Petersen |
| 3,405,613 | A | 10/1968 | Gustafson |
| 3,564,985 | A | 2/1971 | Heller |
| 3,625,489 | A | 12/1971 | Weaver |
| 3,732,023 | A | 5/1973 | Rank et al. |
| 3,807,886 | A | 4/1974 | Cutler |
| 3,820,914 | A | 6/1974 | Zimmerman |
| 3,874,366 | A | 4/1975 | Cutler |
| D236,745 | S | 9/1975 | Fuentes |
| 3,907,450 | A | 9/1975 | Cutler |

(Continued)

FOREIGN PATENT DOCUMENTS

| | | |
|---|---|---|
| CA | 999462 | 11/1976 |
| CA | 1061623 | 9/1979 |

(Continued)

OTHER PUBLICATIONS

Notice of Allowance for U.S. Appl. No. 13/167,888, mailed Aug. 22, 2013 9 pages.

(Continued)

*Primary Examiner* — Raymond W Addie
(74) *Attorney, Agent, or Firm* — Sheridan Ross P.C.

(57) ABSTRACT

The present invention provides a system and method for controlling an asphalt repair apparatus. An additional aspect of the present invention is to provide a system that may position a heater repair element adjacent a targeted asphalt surface, acquire and analyze surface and heater sensing data, and control heater output to prepare the targeted asphalt surface for repair. Further, the system may be configured to control an asphalt repair apparatus to satisfy user-defined asphalt repair requirements.

20 Claims, 5 Drawing Sheets

(56) References Cited

U.S. PATENT DOCUMENTS 3,965,281 A 6/1976 Takase
3,970,404 A 7/1976 Benedetti
3,989,401 A 11/1976 Moench
3,997,276 A 12/1976 Jackson, Sr.
4,007,995 A 2/1977 Rofidal
4,011,023 A 3/1977 Cutler
4,018,540 A 4/1977 Jackson, Sr.
4,072,435 A 2/1978 Coho
4,084,915 A 4/1978 Wiseblood
4,124,325 A 11/1978 Cutler
4,129,398 A 12/1978 Schoelkopf
4,139,318 A 2/1979 Jakob
4,172,679 A 10/1979 Wirtgen
4,226,552 A 10/1980 Moench
4,252,487 A * 2/1981 Jeppson ..... 404/77
4,300,853 A 11/1981 Jones
4,315,700 A 2/1982 Heiligtag et al.
4,319,856 A 3/1982 Jeppson
4,325,580 A 4/1982 Swisher, Jr.
4,335,975 A 6/1982 Schoelkopf
4,347,016 A 8/1982 Sindelar
4,407,605 A 10/1983 Wirtgen
4,453,856 A 6/1984 Chiostri
D277,676 S 2/1985 Neal
4,534,674 A 8/1985 Cutler
4,545,700 A 10/1985 Yates
4,557,626 A 12/1985 McKay
4,561,800 A 12/1985 Hatakenaka
4,594,022 A 6/1986 Jeppson
4,619,550 A 10/1986 Jeppson
4,678,363 A 7/1987 Sterner
4,684,288 A 8/1987 Chapa
4,711,600 A 12/1987 Yates
4,720,207 A 1/1988 Salani
4,749,303 A 6/1988 Keizer et al.
4,780,022 A 10/1988 Ohiba
4,793,730 A 12/1988 Butch
4,793,732 A 12/1988 Jordon
4,849,020 A 7/1989 Osborne
4,929,120 A 5/1990 Wiley et al.
4,938,537 A 7/1990 Rife, Jr. et al.
4,969,772 A 11/1990 Chiba et al.
4,969,773 A 11/1990 Heims
4,969,774 A 11/1990 Arseneault et al.
5,002,426 A 3/1991 Brown et al.
5,026,206 A 6/1991 O'Connor
5,042,973 A 8/1991 Hammarstrand
5,078,540 A 1/1992 Jakob et al.
5,092,706 A 3/1992 Bowen et al.
5,114,284 A 5/1992 Keizer et al.
5,131,788 A 7/1992 Hulicsko
5,148,799 A 9/1992 St-Louis
5,188,481 A 2/1993 O'Brien
5,251,999 A * 10/1993 McCracken ..... 404/109
5,263,769 A 11/1993 Pharr et al.
5,309,702 A 5/1994 Lundahl et al.
5,333,969 A * 8/1994 Blaha et al. ..... 404/91
5,352,275 A 10/1994 Nath et al.
5,378,079 A 1/1995 Omann
5,385,426 A 1/1995 Omann
5,388,893 A 2/1995 Maxwell et al.
D357,483 S 4/1995 Ramsey et al.
5,405,213 A 4/1995 O'Connor
5,419,654 A 5/1995 Kleiger
5,439,313 A 8/1995 Blaha
5,472,292 A 12/1995 Wiley
5,484,224 A 1/1996 Lynch
5,549,412 A 8/1996 Malone
5,556,225 A 9/1996 Marino
5,584,597 A * 12/1996 Lemelson ..... 404/83
5,592,760 A 1/1997 Kohout
5,599,133 A * 2/1997 Costello et al. ..... 404/72
5,607,022 A 3/1997 Walker et al.
5,618,132 A 4/1997 Fogg et al.
5,630,677 A 5/1997 Barroso
5,653,552 A 8/1997 Wiley et al.
5,722,789 A 3/1998 Murray et al.
5,749,674 A 5/1998 Wilson, Sr.
5,752,782 A 5/1998 Hulicsko
5,755,865 A 5/1998 Lukens
5,766,333 A 6/1998 Lukens
5,775,438 A 7/1998 Confoey et al.
5,791,814 A 8/1998 Wiley
5,795,096 A 8/1998 Culver
5,810,471 A 9/1998 Nath et al.
5,827,008 A 10/1998 Smith et al.
5,829,235 A 11/1998 Rice et al.
5,848,755 A 12/1998 Zickell et al.
5,895,171 A 4/1999 Wiley et al.
5,899,630 A 5/1999 Brock
5,928,746 A 7/1999 Dalton et al.
5,938,130 A 8/1999 Zickell
5,947,634 A 9/1999 Robillard
5,947,636 A 9/1999 Mara
5,967,695 A 10/1999 Vural
5,988,935 A 11/1999 Dillingham
5,997,724 A 12/1999 Lukens
6,000,205 A 12/1999 Joray
6,049,658 A 4/2000 Schave et al.
6,074,128 A 6/2000 Marino
6,117,227 A 9/2000 Kitagawa
6,135,567 A 10/2000 Cochran
6,139,612 A 10/2000 Kitagawa et al.
6,186,700 B1 2/2001 Omann
6,213,559 B1 4/2001 Stevens
6,214,103 B1 4/2001 Kitagawa
6,220,782 B1 4/2001 Yates
6,227,620 B1 5/2001 Page
6,227,762 B1 5/2001 Van Velsor
6,290,152 B1 9/2001 Zickell
6,318,928 B1 11/2001 Swearingen
6,371,689 B1 4/2002 Wiley
6,382,871 B1 5/2002 Ross
6,394,696 B1 5/2002 Culver
6,398,453 B1 6/2002 Stegemoeller
6,416,249 B1 7/2002 Crupi
6,422,784 B1 7/2002 Pellegrino et al.
6,439,804 B1 8/2002 Crupi
6,439,806 B1 8/2002 Dillingham
6,497,930 B1 12/2002 Petermeier
6,551,017 B1 4/2003 Strassman
6,584,414 B1 6/2003 Green et al.
6,588,973 B1 7/2003 Omann
6,599,057 B2 7/2003 Thomas et al.
6,626,499 B1 9/2003 Schenk et al.
6,659,684 B1 12/2003 Goodhart et al.
6,669,467 B2 12/2003 Kieswetter
6,681,761 B2 1/2004 Dillingham
6,682,261 B1 1/2004 Karamihas et al.
6,685,465 B2 2/2004 Marquardt
6,695,530 B2 2/2004 Crupi
6,764,542 B1 7/2004 Lackey et al.
6,769,836 B2 8/2004 Lloyd
6,802,897 B1 10/2004 Lackey et al.
6,805,738 B2 10/2004 Tasaki
6,821,052 B2 11/2004 Zurn
6,872,072 B2 3/2005 Kieswetter
6,939,079 B2 9/2005 Lloyd
6,947,636 B2 * 9/2005 Shinozaki et al. ..... 385/37
6,988,849 B1 * 1/2006 Zimmerman ..... 404/95
6,998,010 B2 * 2/2006 Wiley ..... 156/309.6
7,004,675 B2 2/2006 Wayne
7,008,670 B1 3/2006 Freisthler
7,037,036 B2 5/2006 Strassman
7,037,955 B2 5/2006 Timcik et al.
7,070,244 B2 7/2006 Fischer et al.
7,077,601 B2 7/2006 Lloyd
7,104,724 B2 9/2006 Terry
7,134,806 B2 11/2006 Lazic
7,140,693 B2 11/2006 Dubay et al.
7,150,420 B2 12/2006 Packer et al.
7,152,820 B1 12/2006 Baker et al.
7,179,018 B2 2/2007 Hall et al.
7,201,536 B1 4/2007 Westbrook et al.

(56) References Cited

U.S. PATENT DOCUMENTS

| | | | | |
|---|---|---|---|---|
| 7,252,455 | B2 | 8/2007 | Larsen | |
| 7,275,890 | B2 | 10/2007 | Thomas et al. | |
| 7,287,818 | B1 | 10/2007 | Hall et al. | |
| 7,297,720 | B2 | 11/2007 | Meyers et al. | |
| 7,387,464 | B2 | 6/2008 | Hall et al. | |
| 7,387,465 | B2 | 6/2008 | Hall et al. | |
| 7,396,085 | B2 | 7/2008 | Hall et al. | |
| 7,413,375 | B2 | 8/2008 | Hall | |
| 7,413,376 | B2 | 8/2008 | Potts et al. | |
| 7,448,825 | B2 | 11/2008 | Kasahara | |
| 7,455,476 | B2 | 11/2008 | Grubba et al. | |
| 7,458,746 | B1 | 12/2008 | Zimmerman | |
| 7,470,082 | B2 | 12/2008 | Lloyd | |
| 7,473,052 | B2 | 1/2009 | Hall et al. | |
| 7,481,601 | B2 | 1/2009 | Gilchrist | |
| 7,503,202 | B1 | 3/2009 | Kadrmas | |
| 7,544,011 | B2 | 6/2009 | Hall et al. | |
| 7,544,253 | B2 | 6/2009 | Kleiger et al. | |
| 7,546,765 | B1 | 6/2009 | Janke et al. | |
| 7,549,821 | B2 | 6/2009 | Hall et al. | |
| 7,562,563 | B2 | 7/2009 | Wee | |
| 7,578,634 | B2 | 8/2009 | Velsor | |
| 7,585,128 | B2 | 9/2009 | Hall et al. | |
| 7,588,388 | B2 | 9/2009 | Hall et al. | |
| 7,591,607 | B2 | 9/2009 | Hall et al. | |
| 7,591,608 | B2 | 9/2009 | Hall et al. | |
| 7,641,418 | B2 | 1/2010 | Hall et al. | |
| 7,654,772 | B1 | 2/2010 | Zimmerman | |
| 7,686,536 | B2 | 3/2010 | Hall et al. | |
| 7,717,521 | B2 | 5/2010 | Hall et al. | |
| 7,726,905 | B2 | 6/2010 | Hall et al. | |
| 7,740,414 | B2 | 6/2010 | Hall et al. | |
| 7,748,789 | B2 | 7/2010 | Freeburn | |
| 7,780,373 | B2 | 8/2010 | Ustyugov | |
| 7,798,745 | B2 | 9/2010 | Hall et al. | |
| 7,845,878 | B1 | 12/2010 | Godbersen et al. | |
| 7,887,142 | B2 | 2/2011 | Hall et al. | |
| 7,909,532 | B2 | 3/2011 | Johnson et al. | |
| 7,927,413 | B2 | 4/2011 | Brock et al. | |
| 7,980,278 | B2 | 7/2011 | Labbe et al. | |
| 8,016,514 | B2 | 9/2011 | Broadway, III | |
| 8,016,515 | B2 | 9/2011 | Benedetti et al. | |
| 8,061,782 | B2 | 11/2011 | Hall et al. | |
| 8,079,777 | B2 | 12/2011 | Van Velsor | |
| 8,083,434 | B1 | 12/2011 | Gorman et al. | |
| 8,465,225 | B2 | 6/2013 | Groulx et al. | |
| 2003/0026656 | A1 | 2/2003 | Crupi | |
| 2003/0044522 | A1 | 3/2003 | Isozaki | |
| 2004/0099654 | A1 | 5/2004 | Pais | |
| 2004/0116557 | A1 | 6/2004 | Pounds et al. | |
| 2004/0160595 | A1 | 8/2004 | Zivkovic et al. | |
| 2004/0240939 | A1 | 12/2004 | Hays et al. | |
| 2006/0039756 | A1 | 2/2006 | Lemke et al. | |
| 2006/0099031 | A1 | 5/2006 | Rathe | |
| 2006/0104716 | A1 | 5/2006 | Jones | |
| 2006/0196698 | A1 | 9/2006 | Hall et al. | |
| 2006/0204332 | A1 | 9/2006 | Boudreau | |
| 2006/0243463 | A1 | 11/2006 | Mensch | |
| 2006/0285923 | A1 | 12/2006 | Musil et al. | |
| 2007/0098496 | A1* | 5/2007 | Hall et al. | 404/94 |
| 2007/0116519 | A1 | 5/2007 | Haroldsen | |
| 2007/0172313 | A1 | 7/2007 | Lopez | |
| 2007/0220781 | A1 | 9/2007 | Altizer et al. | |
| 2007/0240700 | A1 | 10/2007 | Bucklew | |
| 2008/0008525 | A1 | 1/2008 | Dawson et al. | |
| 2008/0056820 | A1* | 3/2008 | Hall et al. | 404/75 |
| 2008/0082347 | A1 | 4/2008 | Villalobos et al. | |
| 2008/0152427 | A1 | 6/2008 | Gillard et al. | |
| 2008/0226392 | A1 | 9/2008 | Lloyd | |
| 2008/0247823 | A1 | 10/2008 | Will et al. | |
| 2008/0249729 | A1 | 10/2008 | Martinez et al. | |
| 2008/0292401 | A1 | 11/2008 | Potts | |
| 2009/0052988 | A1 | 2/2009 | Belley | |
| 2009/0116905 | A1 | 5/2009 | McDonald | |
| 2009/0136295 | A1 | 5/2009 | Boyd | |
| 2009/0185859 | A1 | 7/2009 | Haroldsen | |
| 2009/0226254 | A1* | 9/2009 | Jones | 404/77 |
| 2009/0297268 | A1 | 12/2009 | Harakawa et al. | |
| 2010/0021233 | A1* | 1/2010 | Chandler | 404/77 |
| 2010/0034586 | A1 | 2/2010 | Bailey et al. | |
| 2010/0055304 | A1 | 3/2010 | Reinke et al. | |
| 2010/0104363 | A1 | 4/2010 | Benedetti | |
| 2010/0115908 | A1 | 5/2010 | Trevillyan et al. | |
| 2010/0189498 | A1* | 7/2010 | Doherty et al. | 404/72 |
| 2010/0203462 | A1 | 8/2010 | Gencer | |
| 2010/0209188 | A1 | 8/2010 | Wiley | |
| 2010/0310312 | A1 | 12/2010 | Mahler | |
| 2010/0316445 | A1 | 12/2010 | Kasahara et al. | |
| 2010/0322710 | A1 | 12/2010 | Ryan | |
| 2010/0322713 | A1 | 12/2010 | Hegg | |
| 2011/0042982 | A1 | 2/2011 | Coutu | |
| 2011/0070024 | A1 | 3/2011 | Kleiger | |
| 2011/0070025 | A1 | 3/2011 | Kleiger | |
| 2011/0085860 | A1 | 4/2011 | Gregerson | |
| 2011/0120443 | A1 | 5/2011 | Stothert et al. | |
| 2011/0163589 | A1 | 7/2011 | Cipriani et al. | |
| 2011/0250016 | A1 | 10/2011 | Giles | |
| 2011/0274487 | A1 | 11/2011 | Sylvester | |
| 2011/0298188 | A1 | 12/2011 | Haubrich et al. | |
| 2012/0027513 | A1 | 2/2012 | Wang | |
| 2012/0253612 | A1 | 10/2012 | Byrne | |
| 2013/0136539 | A1* | 5/2013 | Aardema | 404/75 |
| 2013/0223931 | A1* | 8/2013 | Hegg | 404/77 |

FOREIGN PATENT DOCUMENTS

| | | |
|---|---|---|
| CA | 1063410 | 10/1979 |
| CA | 1065843 | 11/1979 |
| CA | 1081516 | 7/1980 |
| CA | 1093365 | 1/1981 |
| CA | 1134344 | 10/1982 |
| CA | 1169318 | 6/1984 |
| CA | 1214673 | 12/1986 |
| CA | 1225857 | 8/1987 |
| CA | 1226159 | 9/1987 |
| CA | 1235935 | 5/1988 |
| CA | 1237315 | 5/1988 |
| CA | 2002058 | 5/1991 |
| CA | 1300417 | 5/1992 |
| CA | 1304251 | 6/1992 |
| CA | 2087879 | 7/1993 |
| CA | 1328334 | 4/1994 |
| CA | 2021648 | 8/1998 |
| CA | 2061682 | 3/1999 |
| CA | 2251284 | 3/1999 |
| CA | 2366009 | 9/2000 |
| CA | 2287547 | 4/2001 |
| CA | 2428367 | 5/2002 |
| CA | 2334297 | 8/2002 |
| CA | 2131429 | 11/2003 |
| CA | 2409493 | 4/2004 |
| CA | 2647593 | 10/2007 |
| CA | 2705374 | 5/2009 |
| CA | 2252250 | 7/2009 |
| CA | 2575074 | 9/2009 |
| CA | 2721990 | 5/2011 |
| EP | 560021 | 9/1996 |
| EP | 810276 | 12/1997 |
| EP | 985768 | 3/2000 |
| EP | 854235 | 3/2005 |
| EP | 1052334 | 3/2005 |
| EP | 1668185 | 6/2006 |
| EP | 1337711 | 10/2007 |
| EP | 2111436 | 10/2009 |
| EP | 2213799 | 8/2010 |
| EP | 2050875 | 6/2011 |
| EP | 2350390 | 8/2011 |
| EP | 2350391 | 8/2011 |
| EP | 2374934 | 10/2011 |
| WO | WO 99/41456 | 8/1999 |
| WO | WO 00/12820 | 3/2000 |
| WO | WO 00/15910 | 3/2000 |
| WO | WO 01/81894 | 11/2001 |
| WO | WO 02/14610 | 2/2002 |

(56) References Cited

FOREIGN PATENT DOCUMENTS

| | | |
|---|---|---|
| WO | WO 03/050359 | 6/2003 |
| WO | WO 2006/003466 | 1/2006 |
| WO | WO 2006/008187 | 1/2006 |
| WO | WO 2007/000102 | 1/2007 |
| WO | WO 2007/145576 | 2/2008 |
| WO | WO 2008/068877 | 6/2008 |
| WO | WO 2010/031530 | 3/2010 |
| WO | WO 2010/100401 | 9/2010 |
| WO | WO 2010/130143 | 11/2010 |
| WO | WO 2010/121579 | 12/2010 |
| WO | WO 2011/034731 | 3/2011 |
| WO | WO 2011/069191 | 6/2011 |
| WO | WO 2011/086722 | 7/2011 |

OTHER PUBLICATIONS

Notice of Allowance for U.S. Appl. No. 13/848,455, mailed Aug. 20, 2013 7 pages.
Notice of Allowance for U.S. Appl. No. 29/461,750, mailed Oct. 28, 2013, 12 pages.
U.S. Appl. No. 29/461,750, filed Jul. 26, 2013, Giles.
U.S. Appl. No. 14/049,682, filed Oct. 9, 2013, Giles.
U.S. Appl. No. 13/931,076, filed Jun. 28, 2013, Garland et al.
U.S. Appl. No. 12/651,358, filed Dec. 31, 2009, Giles.
U.S. Appl. No. 13/742,928, filed Jan. 16, 2013, Cronin et al.
U.S. Appl. No. 13/848,455, filed Mar. 21, 2013, Giles.
Official Action for U.S. Appl. No. 12/651,358, mailed Sep. 13, 2011, 7 pages.
Official Action for U.S. Appl. No. 12/651,358, mailed Oct. 24, 2011 10 pages.
Official Action for U.S. Appl. No. 12/651,358, mailed Jun. 4, 2012 13 pages.
Official Action for U.S. Appl. No. 12/651,358, mailed May 16, 2013 12 pages.
Official Action for U.S. Appl. No. 13/167,888, mailed Sep. 7, 2012 6 pages.
Official Action for U.S. Appl. No. 13/167,888, mailed Dec. 4, 2012 8 pages.
Notice of Allowance for U.S. Appl. No. 14/049,682, mailed Dec. 18, 2013 11 pages.

* cited by examiner

SYSTEM AND METHOD FOR CONTROLLING AN ASPHALT REPAIR APPARATUS

CROSS REFERENCE TO RELATED APPLICATIONS

This application cross-references U.S. patent application Ser. No. 12/651,358 filed Dec. 31, 2009 entitled "Infrared Heating System and Method for Heating Surfaces," U.S. patent application Ser. No. 13/167,888 filed Jun. 24, 2011 entitled "Asphalt Repair System and Method," and U.S. patent application Ser. No. 13/742,928 filed Jan. 16, 2013 entitled "System and Method for Sensing and Managing Pothole Location and Pothole Characteristics," the disclosures of each of which are incorporated herein by reference in their entirety.

FIELD OF THE INVENTION

Embodiments of the present invention are generally related to roadway maintenance and repair, and, in particular, to a system and method for controlling an asphalt repair apparatus for repairing potholes and other roadway deformities.

BACKGROUND OF THE INVENTION

Roadway repair and maintenance are a ubiquitous problem that impose financial obligations on roadway authorities and present annoyances, if not costly hazards, to motorists. Asphalt surfaces, such as roads, driveways and parking lots, may suffer damage through a combination of infiltrating water and the continuous flow of moving vehicles. For example, potholes are a recurring problem creating inevitable damage to roadway surfaces from traffic, construction, and the environment. The enormous number and variety of paved roads makes it difficult for federal, state, and local municipalities to implement repairs in a timely, cost effective and safe manner.

Conventionally, repairing damaged roadways is done on an ad hoc basis resulting in inefficiencies and varying effectiveness. For example, repair of asphalt surfaces is typically done by removing a damaged section (e.g. a section surrounding a pothole) and re-laying the section with fresh asphalt or simply patching the area with an asphalt compound. Based on the repair capabilities and the experience of the repair crew, ambient grade temperature, asphalt repair material and the effectiveness of the repair equipment, the resulting roadway repair will vary in quality and effectiveness.

Effective and efficient repair of asphalt roadway surfaces requires control of several variables based on the characteristics of the targeted repair site, ambient conditions, capabilities of the repair device and crew and operational requirements. Currently, asphalt repair is performed through application of heat to a targeted area of repair. The resulting softened area (i.e. an area with decreased hardness) is then better able to receive and adhere to replacement or supplement asphalt applied to the area. However, effective softening of the targeted area requires applying heat in a deliberate and controlled fashion adapted to the composition of the asphalt involved, the outside ambient temperature, the temperature of the targeted repair area, and the degree of softening of the targeted area achieved. If the targeted area is improperly heated or softened, the replacement asphalt will not adhere to the repair area and/or seam lines may result. Seam lines are problematic because they reflect a discontinuity between the repair and the asphalt roadway and commonly result in uneven pavement and pothole formation.

In current practice, the heat required to soften a targeted asphalt area is a manual iterative process, in which a road crew member measures softness by driving a shovel into the asphalt to evaluate pliability. Such a process widely varies in accuracy based on, for example, the skills of the crew member and the location and frequency of the shovel-measurement. Measurements taken in only one location, for example, will likely not represent the overall area to be repaired. A more effective repair will use multiple measurements of temperature and softness from several locations within the repair site during the course of the repair.

Furthermore, the current asphalt repair process is energy and time inefficient. The heat source is manually positioned and oriented relative to the targeted repair site, and heat applied to bring the repair area to within a targeted temperature and softness range. Generally, an efficient asphalt repair process will minimize the time required to bring the material up to a required temperature and softness level while avoiding overheating. If a maximum temperature is exceeded (for example, approximately 375 deg. F.), volatile oils burn off and the repair surface may be compromised. However, if the temperature is increased too slowly, more energy is consumed and crew on-site costs will increase.

Thus, there is a long-felt need for a system and method for provides a system and method for controlling an asphalt repair apparatus, as provided in the present invention. An additional aspect of the present invention is to provide a system that may position a heater repair element adjacent a targeted asphalt surface, acquire and analyze surface and heater sensing data, and control heater output to prepare the targeted asphalt surface for repair. Further, the system may be configured to control an asphalt repair apparatus to satisfy user-defined asphalt repair requirements. The system and method provides several benefits, to include providing a more effective and efficient repair of asphalt roadways thereby yielding a more cost and time effective utilization of material, labor, and equipment. Repaired roadways will be more robust and less prone to future damage.

SUMMARY OF THE INVENTION

It is one aspect of the present invention provides a system and method for controlling an asphalt repair apparatus. An additional aspect of the present invention is to provide a system that may position a heater repair element adjacent a targeted asphalt surface, acquire and analyze surface and heater sensing data, and control heater output to prepare the targeted asphalt surface for repair. Further, the system may be configured to control an asphalt repair apparatus to satisfy user-selectable asphalt repair requirements.

In one aspect of the invention, a roadway repair apparatus is disclosed, the roadway repair apparatus comprising: a heater configured to heat a roadway repair site to a selected temperature and a selected hardness, the heater interconnected to a roadway machine configured to position the heater proximate to the roadway repair site; at least one heater temperature sensor disposed proximate to or on the heater; at least one material hardness sensor disposed proximate to or on the heater; a power unit in communication with the heater and adapted to provide energy to the heater; a controller in communication with the power unit and adapted to receive control measurement inputs comprising a heater temperature measurement input from the heater temperature sensor and a repair site material hardness measurement input from the material hardness sensor; and wherein the controller determines the energy level of the power unit based on the control inputs.

In another aspect of the invention, a method for repair of a roadway surface is provided, the process comprising the steps of: positioning a heater proximate to a roadway repair site; measuring a repair site temperature and a repair site hardness; determining a power level for the heater based on at least one of the repair site temperature and the repair site hardness; activating the heater at the determined power level wherein heat from the heater is imparted to the repair site; heating the repair site until at least one of a selectable repair site temperature and repair site hardness is achieved; providing an asphalt material and a conditioner; conditioning an area surrounding the repair site by beveling an edge of the repair site to a predetermined angle; inserting the asphalt material and the conditioner into the repair site; and compacting the asphalt material and the conditioner into the repair site.

In a further aspect of the invention, an asphalt roadway repair system is disclosed, the asphalt roadway repair system comprising: a heater configured to heat an asphalt repair site of a roadway surface to a predetermined temperature and a predetermined hardness, the heater adapted to interconnect to an apparatus configured to position the heater in a preferred orientation substantially parallel to the asphalt repair site; at least one heater temperature sensor disposed proximate to the heater; at least one material hardness sensor disposed proximate to the heater; a power unit in communication with the heater and configured to provide a power level to the heater; a controller in communication with the power unit and adapted to receive control measurement inputs comprising a heater temperature measurement input from the heater temperature sensor and a repair site material hardness measurement input from the material hardness sensor; wherein the controller determines the power level of the power unit based on the control inputs.

The term "automatic" and variations thereof, as used herein, refers to any process or operation done without material human input when the process or operation is performed. However, a process or operation can be automatic, even though performance of the process or operation uses material or immaterial human input, if the input is received before performance of the process or operation. Human input is deemed to be material if such input influences how the process or operation will be performed. Human input that consents to the performance of the process or operation is not deemed to be "material."

The terms "determine", "calculate" and "compute," and variations thereof, as used herein, are used interchangeably and include any type of methodology, process, mathematical operation or technique.

The terms "softness" and "softened" as used herein refers to the degree of material hardness of a targeted roadway repair area.

The term "roadway" as used herein refers to roads of all capacity, whether private or public, of various pavement compositions to include concrete, asphalt, asphalt concrete, and reclaimed asphalt pavement.

The term "roadway anomaly" as used herein refers to any atypical or degraded characteristic of a prototypical roadway, to include potholes, ruts, crowns, upheaval, raveling, shoving, stripping, grade depressions, and cracking of various types to include line cracking and alligator cracking.

The term "module" as used herein refers to any known or later developed hardware, software, firmware, artificial intelligence, fuzzy logic, or combination of hardware and software that is capable of performing the functionality associated with that element.

It shall be understood that the term "means" as used herein shall be given its broadest possible interpretation in accordance with 35 U.S.C., Section 112, Paragraph 6.

Accordingly, a claim incorporating the term "means" shall cover all structures, materials, or acts set forth herein, and all of the equivalents thereof. Further, the structures, materials or acts and the equivalents thereof shall include all those described in the summary of the invention, brief description of the drawings, detailed description, abstract, and claims themselves.

This Summary of the Invention is neither intended nor should it be construed as being representative of the full extent and scope of the present disclosure. The present disclosure is set forth in various levels of detail in the Summary of the Invention as well as in the attached drawings and the Detailed Description of the Invention, and no limitation as to the scope of the present disclosure is intended by either the inclusion or non-inclusion of elements, components, etc. in this Summary of the Invention. Additional aspects of the present disclosure will become more readily apparent from the Detailed Description, particularly when taken together with the drawings.

The above-described benefits, embodiments, and/or characterizations are not necessarily complete or exhaustive, and in particular, as to the patentable subject matter disclosed herein. Other benefits, embodiments, and/or characterizations of the present disclosure are possible utilizing, alone or in combination, as set forth above and/or described in the accompanying figures and/or in the description herein below. However, the Detailed Description of the Invention, the drawing figures, and the exemplary claim set forth herein, taken in conjunction with this Summary of the Invention, define the invention.

BRIEF DESCRIPTION OF THE DRAWINGS

The accompanying drawings, which are incorporated in and constitute a part of the specification, illustrate embodiments of the invention and together with the general description of the invention given above, and the detailed description of the drawings given below, serve to explain the principals of this invention.

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

FIGS. 1-5 show various aspects and embodiments of the system 2 and method 100 for controlling an asphalt repair apparatus of the present invention. The system 2 may be used to position a heater repair element adjacent a targeted asphalt surface, acquire and analyze surface and heater sensing data, and control heater output to prepare the targeted asphalt surface for repair. User-defined asphalt repair requirements may be input to the system 2 and method 100 to direct the asphalt repair.

Figure 1:
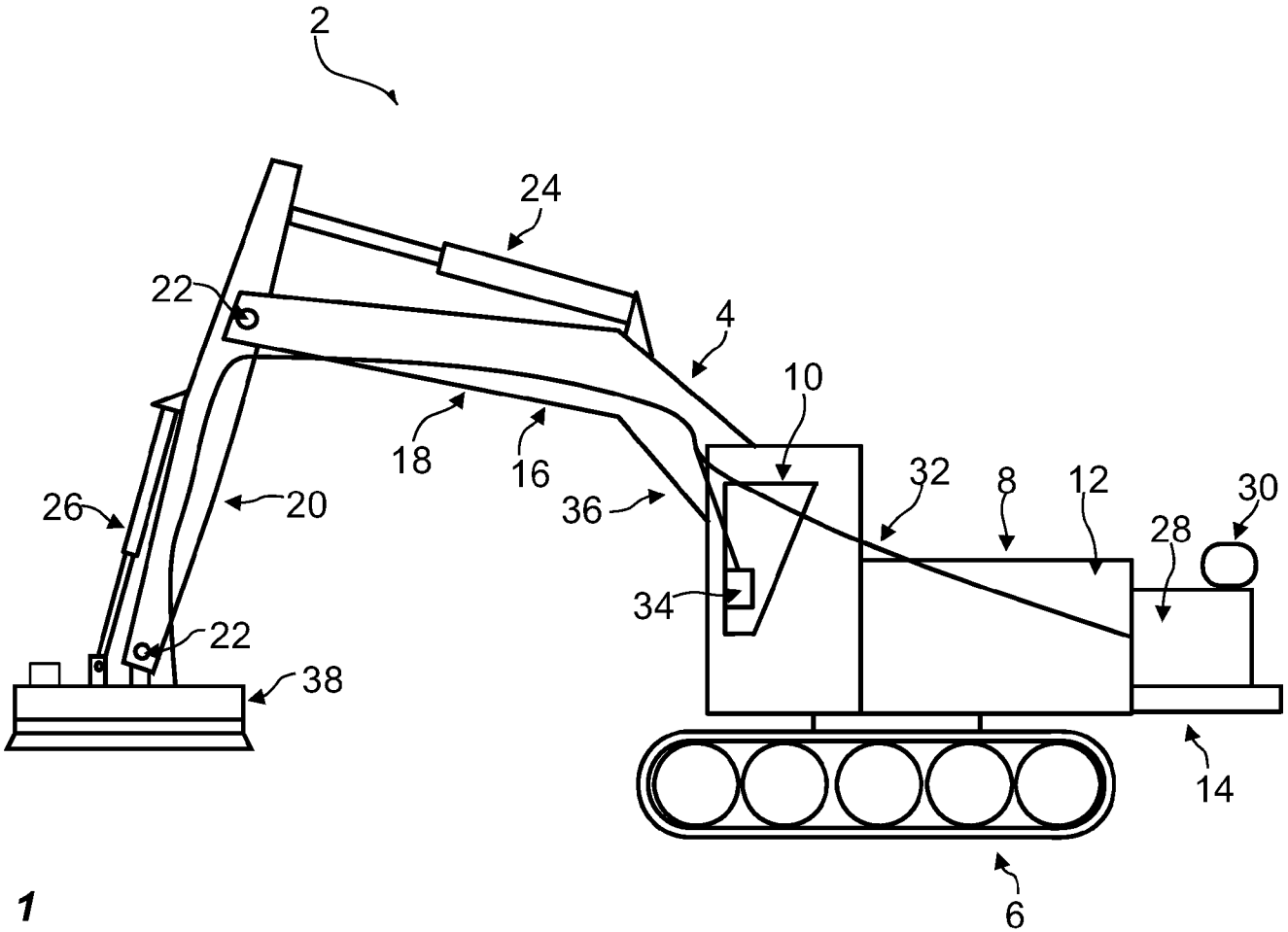
FIG. 1 is a representation of components of an asphalt repair apparatus.

Referring to FIG. 1, a representation of components used in a heating system ("system") 2 for controlling an asphalt repair machine or apparatus 4 is provided. Generally, the system 2 is used to heat an asphalt surface under repair. The system 2 includes an asphalt repair apparatus 4. The asphalt repair apparatus 4 may include tracks 6 and a body portion 8. The body portion 8 includes an operator compartment 10, a controller 34, an engine compartment 12, and a platform 14. The system 2 also includes a boom 16. The boom 16 includes a first portion 18, a second portion 20, pivot points 22, a first hydraulic cylinder 24, a heating component or infrared heater 38 and a second hydraulic cylinder 26. Finally, the system 2 further includes a diesel powered generator 28, a dedicated fuel tank 30 and a power cable 32.

In form and function, the asphalt repair apparatus 4 may have the general characteristics of an excavation machine, such as a track hoe or back hoe. The tracks 6 may include a pair of tracks for providing mobility to asphalt repair apparatus 4. The body portion 8 is generally disposed above tracks 6, but may be positioned in alternate locations which are well known by those skilled in the art.

The body portion 8 includes the operator compartment 10, the engine compartment 12, and the platform 14. The operator compartment 10 may include those necessary control interfaces that allow an operator to control the asphalt repair apparatus 4. The engine compartment 12 may house a diesel engine for providing power to the tracks 6. The power may be provided by other means than a diesel engine, to include but not limited to a gasoline engine, natural gas engine, hybrid engine, bio-fuel engine, electric engine and hybrids thereof. The diesel engine may also provide power to one or more hydraulic pumps to actuate a first hydraulic cylinder 24 and a second hydraulic cylinder 26. Extending from the body portion 8 may be an arm or boom 16. The boom 16 includes a first portion 18 and a second portion 20 pivotally interconnected at an upper pivot point 22. The first hydraulic cylinder 24, which gets its power from the one or more hydraulic pumps, allows an operator to move a first portion 18 with respect to a second portion 20.

The distal end of the second portion 20 of the boom 16 may be adapted to removably receive attachments. The infrared heater 38 is shown attached to the distal end of the second portion 20 of the boom 16. An infrared heater 38, as further described in FIG. 2, heats the asphalt surface targeted for repair. The second hydraulic cylinder 26 allows an operator to further position infrared heater 38. It will be appreciated that since the infrared heater 38 is mounted to the end of the boom 16, an operator can easily position the infrared heater 38 close to any location within reach of the boom 16.

In other embodiments, the boom and/or the infrared heater may be controlled remotely by a remote control unit. The remote control unit, for example, may control the orientation and position of the infrared heater 38 and/or the power or energy delivered to the infrared heater.

Sensors are mounted on the infrared heater 38 to monitor and measure the position of the heater 38 and the condition of the asphalt surface targeted for repair. The sensors may include distance measuring sensors to include infrared, radar, ladar and sonar sensors and orientation sensors to include inclinometers and servo inclinometers such as a Sherborne LSW. Also, temperature sensors, such as an Omega 5TC, may be used to monitor the temperature of the asphalt surface and/or the heater 38. Finally, penetrometers, such as the Humboldt HS-4210, may be used to measure the hardness of the asphalt surface. Sensors are described in further detail in the description of infrared heater 134 in FIG. 2.

The diesel powered generator 28 is mounted on the platform 14 and may provide power to infrared heater 38. The dedicated fuel tank 30 may provide fuel for diesel powered generator 28, possibly for up to eight (8) hours of operation. Diesel powered generator 28 may include an electric start. In an embodiment of the present disclosure, diesel powered generator 28 may be mounted to platform 14 using spring mounted vibration isolators (not shown). In an embodiment of the present disclosure, diesel powered generator 28 may produce about 45 KW, single phase. Diesel powered generator 28 may provide power to infrared heater 38 via the power cable 32.

The controller 34 may be located in the operator compartment 10 to enable an operator to control infrared heater 38 operations. The controller 34 may be connected to infrared heater 38 by a control wiring 36. Controller 34 functions include monitoring infrared heater 38 and initiating or terminating the operation of infrared heater 38, as described in the method 100 for controlling an asphalt repair apparatus of FIG. 5. For example, the controller 34 may control infrared heater 38 such that the heater 38 may be turned off after a preset amount of time or when the material hardness is achieved.

The overall operation of heating system 2 may be better understood in reference to the following illustrative example, which should not be construed as limiting the functional and operational characteristics of system 2.

In operation, for example, infrared heater 38 is controlled by an operator to apply heat to soften asphalt for repair purposes. For example, the operator may position the infrared heater 38 over the asphalt surrounding a pothole prior to applying a patch. The height of infrared heater 38 above the asphalt surface must be maintained for proper operation. The operator may then activate diesel powered generator 28 using controller 34, thereby energizing individual heating elements within infrared heater 38. Controller 34 may regulate the amount of time that power is provided to the heating elements. Once the surface has been sufficiently softened both within and around a perimeter of the pothole by a predetermined distance, infrared heater 38 may be easily re-positioned to another desired location while the repair takes place. The repair may comprise providing an asphalt material and a conditioner, conditioning an area surrounding the repair site by beveling an edge of the repair site to a predetermined angle, inserting the asphalt material and the conditioner into the repair site, and compacting the asphalt material and the conditioner into the repair site. In some instances, the infrared heater 38 may supply sufficient heat such that additional patching material is not required. In other words, the level-out a formerly irregularly-shaped pothole shaped with a ring of excess asphalt surrounding the pothole, such that the excess material of the ring is used to fill the pothole.

Figure 2:
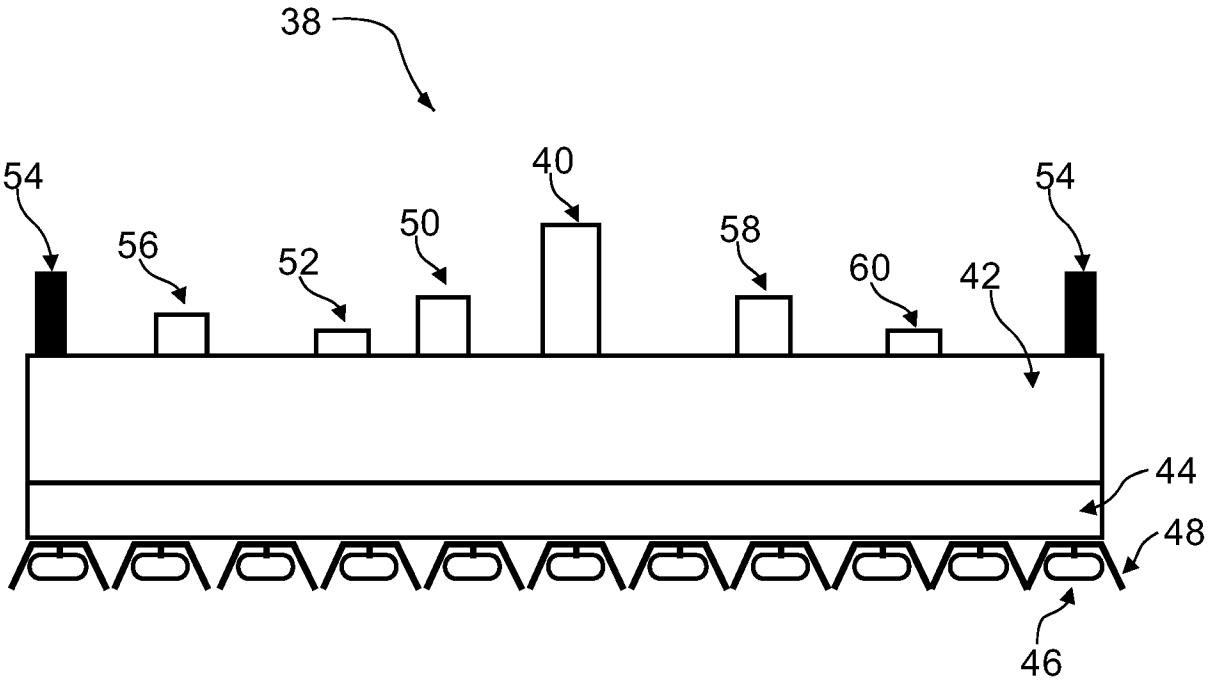
FIG. 2 is a cross-sectional side elevation view of a heating component of an asphalt repair apparatus.

Referring to FIG. 2, a cross-sectional side elevation view of a heating component or infrared heater 38 of an asphalt repair apparatus 4 in one embodiment of the system 2 is depicted. Infrared heater 38 imparts heat to a targeted asphalt repair site so as to raise the temperature and softening the structure to enable repair. Infrared heater 38 is configured with one or more infrared heating elements 46, and one or more reflecting devices 218, on the lower surface of the infrared heater 38. Generally, the infrared heater 38 comprises a base 42, an insulating layer 44, an electrical coupling 50, a current regulator 52, penetrometers 54, thermal sensors 58 and servo inclinometers 60, and attaches to the asphalt repair apparatus 4 by universal attachment device 40. In operation, infrared heater 38 is attached to distal end of second portion 20 of boom 16 by the universal attachment device 40. Universal attachment device 40 may extend from the base 42. Disposed on the underside of base 42 may be the insulating layer 44. In one embodiment of the present disclosure, insulating layer 44 may comprise ceramic material or any other type of insulator.

Disposed on the underside of insulating layer 44 may be a bank of the infrared heating elements 46. The reflecting devices 48 may direct the heat generated by infrared heating elements 46 outwardly and away from infrared heater 38. The electrical coupling 50 may provide a connection for power cable 32 and control wiring 36. Infrared heater 38 may further comprise the current regulator 52, which is able to regulate the amount of current flowing through infrared heating elements 46 based upon control signals from controller 34. Input signals from the penetrometers 54 are used to determine the amount of heat required to achieve proper material hardness. In the embodiment of FIG. 2, four penetrometers 54 are located at each corner of infrared heater 38. Penetrometers 54 are sensors that measure asphalt hardness, such as the HS-4210 made by the Humboldt manufacturing company.

The position of the infrared heater 38 is measured by position sensor element 56. In one embodiment, the position sensor measures position between the heater 38 and the repair site by use of means comprising radar, ladar, sonar and infrared. In one embodiment, the translation of the penetrometer from the heater 38 to the repair site is used to provide relative positioning of the infrared heater 38 above the repair site. Means to measure such translation include use of a linear variable differential transducer (LVDT), such as an Omega LD620. Thermal sensors 58 comprise temperature sensors, such as an Omega 5TC, and are used to monitor the temperature of the asphalt surface to be repaired, the infrared heater 38 and/or one or more of the infrared heater elements 46. Inclinometers 60 may be servo inclinometers such as a Sherborne LSW, and measure the orientation of the infrared heater 38 relative to the targeted repair site. Inclinometers may also be rotary variable differential transducers (RVDT). Control wiring 36 connects penetrometers 54, position sensor element 56, thermal sensors 58, and inclinometers 60 to controller 34.

Figure 3:
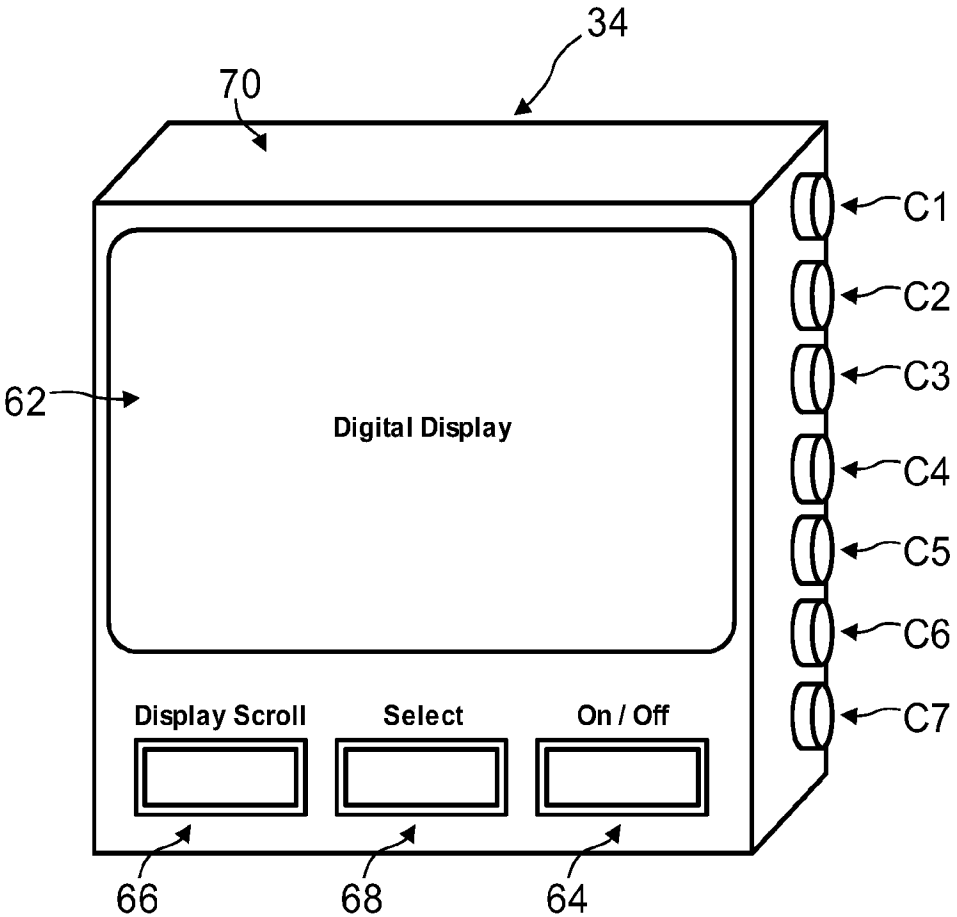
FIG. 3 is a perspective view of a controller component of a system for control of an asphalt repair apparatus.

FIG. 3 is a perspective view of a controller 34 of a system for control of an asphalt repair apparatus 4. Generally, controller 34 monitors and controls the operation of infrared heater 38 to efficiently and effectively enable the repair of a targeted asphalt repair site. Controller 34 includes a chassis 70, control logic electronics, a digital display 62, an on/off switch 64, a display scroll 66, a select 68, and connectors C1-C7. Controller 34 is mounted such that an operator has access to the digital display 62, the on/off switch 64, the display scroll 66 and the select 68.

Figure 4:
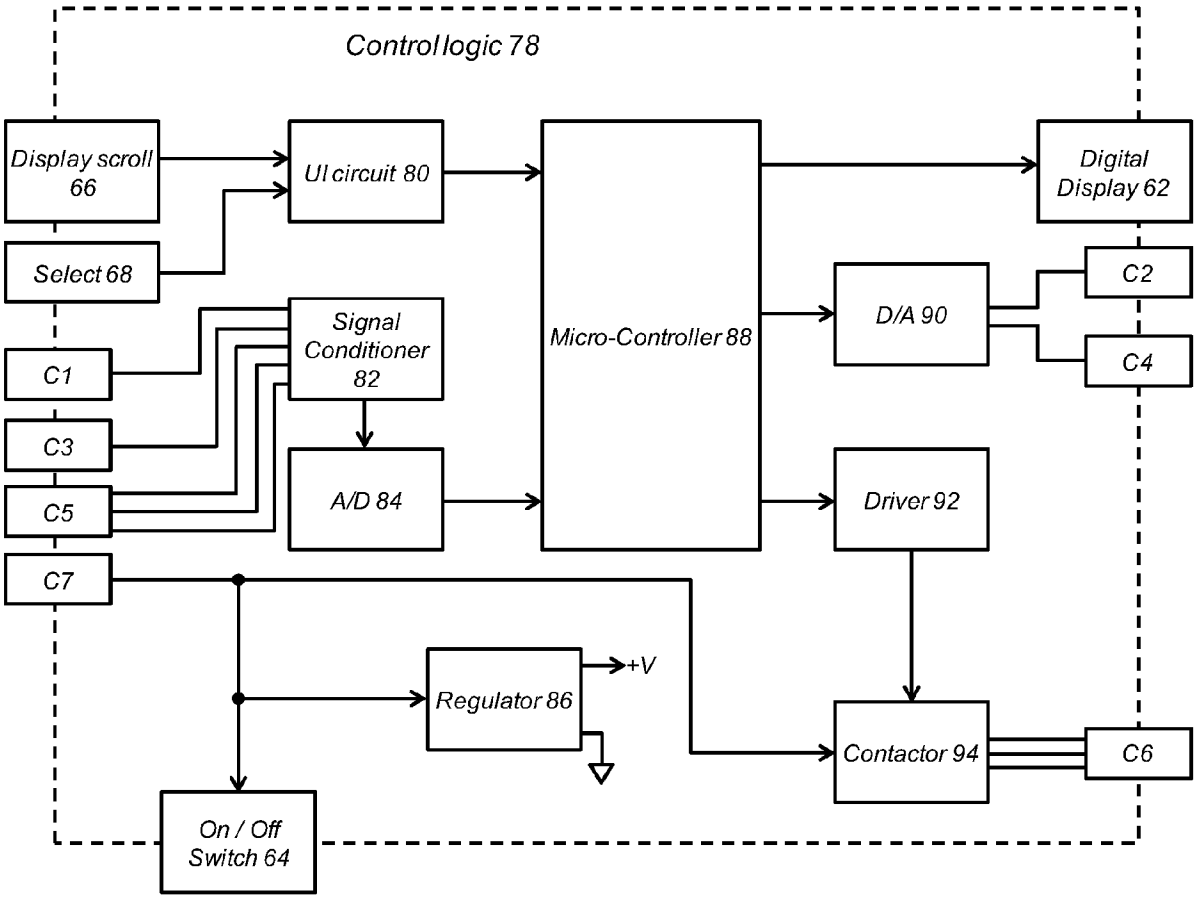
FIG. 4 is a schematic diagram of a controller component of a system for control of an asphalt repair apparatus.

The chassis 70 is the housing for controller 34, which contains control logic electronics 78 of FIG. 4. Control logic electronics 78 are used, among other things, to process sensor data collected from the aforementioned sensors disposed on the infrared heater 38 and to provide control inputs for the infrared heater 38 and/or boom actuators 24 and 26, which control the position of infrared heater 38 above the asphalt surface.

Digital display 62 is a user interface for operator control of heating system 2. Digital display 62 provides a display for monitoring operational modes and system feedback, including sensor measurements, asphalt surface temperature, and hardness measurements. The on/off switch 64 is used to initiate or terminate the process for infrared heater 38. Controller 34 may be configured for levels of automation of the system 2. For example, the user may select a desired position (e.g. 12 inches) of the infrared heater 38 above the repair area and a desired orientation (e.g. parallel) of the infrared heater 38 with respect to the repair area, and then direct the controller 34 to maintain the infrared heater 38 at those selected values. In such a scenario, the controller 34 would maintain the user-selected values for infrared heater 38 position and orientation by, for example, actuation of one or more of actuators 24, 26. Display scroll 66 is a scroll button that allows the view on digital display 62 to change page views (for example, from a control operations window to a sensor data information window) that display information collected from sensors in a page format. Select 68 is a select switch that allows an operator to make menu choices visible on display scroll 66.

Each of connectors C1-C7 may be common industrial connectors, such as a circular connector, used to receive a portion of control wiring 16. C1 contains, in part, conductors that receive signals used to determine the lateral orientation or stability (i.e., level relative to a first axis) of infrared heater 38 (for example, a Sherborne LSW, which provides machine attitude to within a 3 degrees of resolution).

Connector C2 contains, in part, conductors that receive signals used to determine machine attitude orientation (i.e., level relative to a second axis) of infrared heater 38 (for example, a Sherborne LSW, which provides machine attitude to within a 3 degrees of resolution). Connector C3 contains, in part, conductors that carry temperature sense signals collected from thermal sensors 58 to determine the temperature in infrared heater 38 and the temperature of the asphalt using a temperature sensing circuit contained within controller 34. Connector C4 contains, in part, conductors that carry generator control signals from controller 34 to diesel powered generator 28 via a portion of control wiring 36 and conductors that carry positioning control signals from controller 34 to hydraulic pumps. Generator control signals are used to regulate the electric current produced by the generator 28. Positioning control signals actuate second hydraulic cylinder 26 and position boom 16 to raise or lower the height of infrared heater 38 above the asphalt surface and/or orientation of infrared heater 38. Connector C5 contains, in part, conductors that carry sensor signals from infrared heater 38 sensors that are used to determine asphalt physical characteristics (such as depth, temperature, and hardness) and the operating parameters of infrared heater 38 (such as temperature and the height of infrared heater 38 above the asphalt surface). Connector C6 contains, in part, conductors that deliver power to infrared heater 38 via a portion of control wiring 36. Connector C7 contains, in part, conductors that receive power from diesel powered generator 28 via a portion of control wiring 16.

The overall operation of controller 34 may be better understood in reference to the following operating example, which should not be construed as limiting the functional and operational characteristics of controller 34. In operation, for example, an operator powers up controller 34 by pressing on/off switch 64. The operator activates infrared heater 38 by using display scroll 66 to scroll digital display 62 to identifiers of the individual heating coils and using select 68 to select individual heating coils and set the infrared heater 38 power level within the control page. Controller 34 communicates generator control signals to the generator 28 via Connector C4 over a portion of control wiring 146. The generator control signals regulate the electric current produced by the generator 28 to the selected power level setting. Connector C7 receives power from the generator 28 and powers specific individual heating coils of infrared heater 38 via Connector C6 to produce the operator-selected heating level.

FIG. 4 is a schematic diagram of control logic 78 of a controller 34 of a system for control of an asphalt repair apparatus 4. Control logic 78 is used, for example, to process sensor data collected from sensors disposed on the infrared heater 38 and to provide control inputs for infrared heater 38 and control actuators. The control actuators 24, 26 control the position and orientation of infrared heater 38 above the asphalt surface, as per controller method 100 (discussed below with respect to FIG. 5).

Control logic 78 includes display scroll 66, select 68, Connectors C1-C7, on/off switch 64, digital display 62, a User Interface (UI) circuit 80, a signal conditioner 82, an Analog to Digital Converter (A/D) 84, a regulator 86, a micro-controller 88, a Digital to Analog Converter (D/A) 90, a driver 92, and a contactor 94. Further, control logic includes digital display 62, on/off switch 64, display scroll 66 and select 68.

The UI circuit 80 is a user interface circuit that buffers and conditions outputs from display scroll 66 and select 68 and creates a digital signal that is compatible with the micro-controller 88 input signal level requirements. The signal conditioner 82 receives sensor inputs from Connectors C1, C3 and C5 and provides input protection for the inputs of the A/D 84. In one embodiment, element A/D 84 is an analog to digital converter manufactured by Maxim Integrated Products. In one embodiment, micro-controller 88 is a H8S/2623F 16-Bit Single-Chip Microcontroller with on-chip flash memory manufactured by Renesas Electronics. The regulator 86 is a switch mode DC-DC regulator used to power all internal electronics, such as the MAX5986A manufactured by Maxim Integrated Products. In one embodiment, the D/A 90 is a digital to analog converter is the DAC3152 12-Bit digital-to-analog converter manufactured by Texas Instruments that delivers control outputs via Connectors C2 and C4. The driver 92 is a level shifter used to buffer the control signals of micro-controller 88 to control the operation of the contactor 94. Contactor 94 is an electrically controlled switch that receives power from Connector C7 and is used to deliver power to infrared heater 38 through Connector C6.

In one embodiment, the controller 34 determines an adjustment to the position of the heater 38 based on receiving a control measurement input from the vertical position sensor and the orientation sensor. In one embodiment, the controller 34 provides a control input to the power unit to control the power to the heater 38. In one embodiment, the controller 34 utilizes control algorithms comprising at least one of on/off control, proportional control, differential control, integral control, state estimation, adaptive control and stochastic signal processing.

Figure 5:
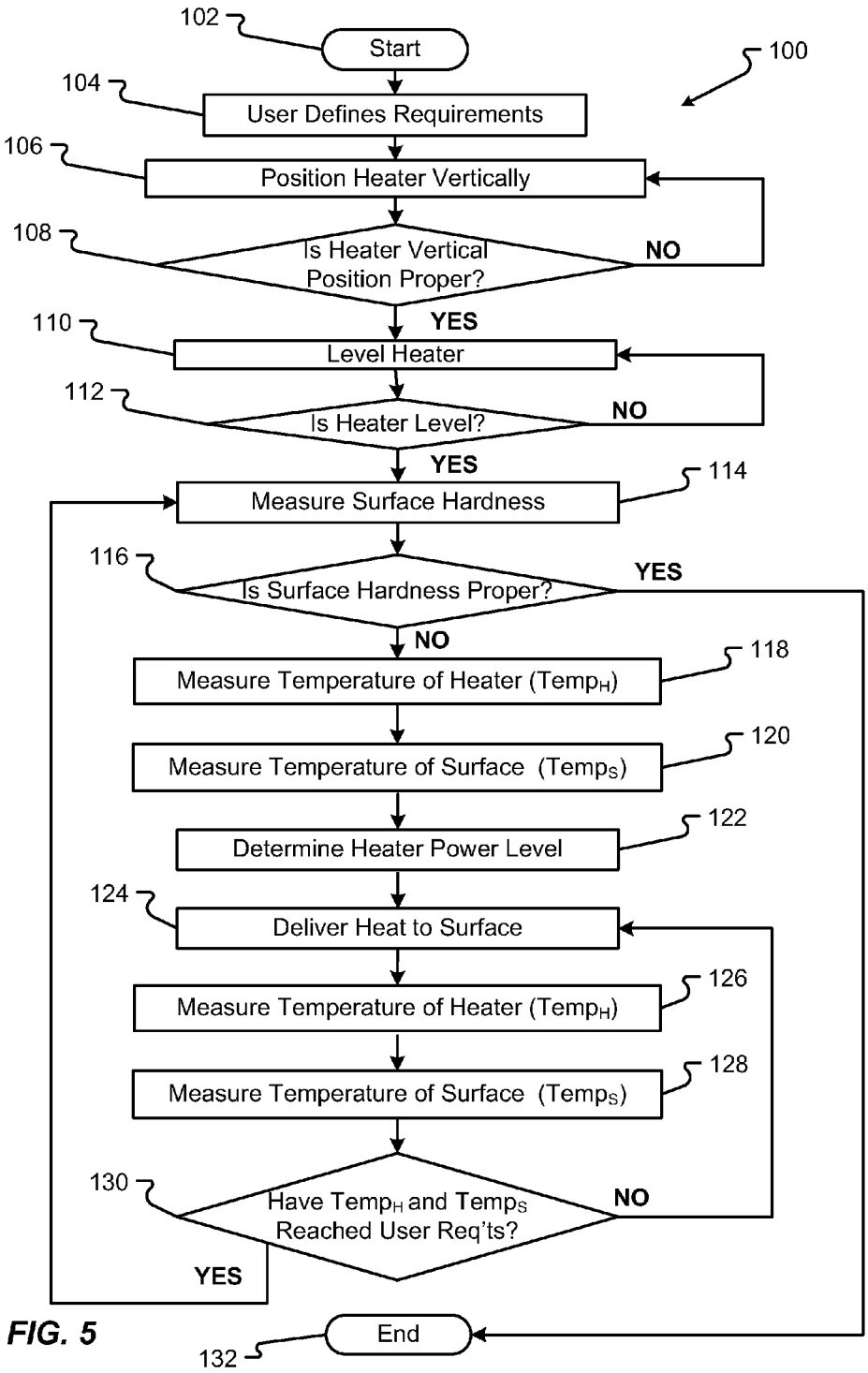
FIG. 5 is a flow diagram of an embodiment of a method for controlling an asphalt repair apparatus.

An embodiment of a method 100 for controlling an asphalt repair apparatus is shown in FIG. 5. A general order for the steps of the method 100 is shown in FIG. 5. Generally, the method 100 starts with a start operation 102 and ends with an end operation 132. The method 100 can include more or fewer steps or can be arranged in a different sequence than those shown in FIG. 5. The method 100 can be executed as a set of computer-executable instructions executed by a computer system and encoded or stored on a computer readable medium.

A user defines asphalt repair requirements in step 104. For example, the user may define the safe temperature zones for heating of the repair area. A typical safe temperature zone is approximately between 275 and 300 deg. F. Further, the use may specify a target total time for heating of the targeted repair area, and/or a target energy consumption metric. Additionally or alternatively, the user may specify a desired vertical distance to remain between the heater element 38 and the repair site, such as 3 inches. The user may be staff from a maintenance department of a public works department.

In step 106 the heater 38 in activated and nominally positioned vertically above the repair site per the specification provided in step 104. The heater 38 is activated by an operator or user in operator compartment 10 activating on/off switch 64 of controller 34. The infrared heater 38 is activated by scrolling digital display 62, using display scroll 66, and selecting a commence heating mode using select 68.

In step 108 a query is made to determine if the vertical positioning is proper, i.e. if the vertical position is as set by the user requirements of step 104. Vertical positioning sensors 56 provide a measurement of the height of the infrared heater 38 above the repair site to the controller 34. If the heater 38 vertical position is determined to be proper (i.e. within a set tolerance or range), the method continues to step 110. If the vertical position of heater 38 is instead determined to not be proper, the method enters step 106 and the heater 38 is re-positioned vertically. In manual mode, the vertical position adjustment is made by a user/operator, who manipulates one or more of actuators 24 and 26 to adjust the vertical position of heater 38. In automatic mode, one or more of actuators 24 and 26 would be actuated automatically as directed by controller 34.

In step 110 the orientation, i.e. the pitch or roll, of the heater 38 is nominally positioned. Typically, the nominal orientation will be substantially parallel to the roadway surface and/or the roadway repair area (e.g. pothole) targeted for repair. Note that in many situations the heater 38 is not oriented in an earth-referenced horizontally flat orientation, because many repairs are performed on roads with crowns, ruts or otherwise non-horizontal surfaces.

In step 112 a query is made to determine if the heater 38 orientation is properly level, i.e. if the heater 38 orientation is as set by the user requirements of step 104. Heater orientation sensors 60 provide a measurement of the orientation of the infrared heater 38 above the repair site to the controller 34. If the heater 38 orientation is determined to be level as defined (i.e. within a set tolerance or range), the method continues to step 114. If the orientation of heater 38 is instead determined to not be properly level, the method enters step 110 and the heater 38 is re-oriented. In manual mode, the orientation adjustment is made by a user/operator, who manipulates one or more of actuators 24 and 26 to adjust the orientation position of heater 38. In automatic mode, one or more of actuators 24 and 26 would be actuated automatically as directed by controller 34. In one embodiment, the heater 38 must be oriented within ±3 degrees relative to an earth-horizon.

In step 114 the hardness of the repair surface is measured. One or more hardness sensors 54, such as penetrometers, provide a measure of repair area hardness to controller 34. Material hardness is determined to a depth of, for example, 80 millimeters below the surface. As asphalt material composition varies from one locality to the next, a penetration index is used to determine the appropriate depth. The penetration index will vary depending upon the amount of bitumen present in the asphalt under repair.

In step 116 a query is made to determine if the surface hardness is proper, that is, if it is within a range or tolerance to repair. Step 116 is performed by controller 34 upon receipt of data from hardness sensors 54. If the penetration index provided by hardness sensors 54 is between −2 and 2, the material has reached the correct hardness and the method proceeds to end step 132. If not, the method continues through a series of steps involving the monitoring and control of applying heat to the repair surface, beginning with step 118. In step 116, the controller 34 may perform any of several additional functions upon receipt of the hardness data from hardness sensor 54. For example, the controller 34 may initially assess, upon start-up, if the hardness of the asphalt surface is within proper limits for a repair to take place.

In step 118, temperature sensors 58 measure temperature ($TEMP_H$) of infrared heater 38. In step 120, temperature sensors 58 measure temperature of the repair surface ($TEMP_S$) and may additionally measure ambient air temperature.

In step 122, the power level for the heater 38 is determined by controller 34. The power level is determined by considering $TEMP_H$, $TEMP_S$ of respective steps 118 and 120, user requirements provided in step 104, and surface hardness measures of step 114. The controller 34 may also remove temperature-dependent errors in penetrometer-type hardness sensors 54 based on receipt of repair surface ($TEMP_S$) data.

In step 124, heater from heater 38 is delivered to the repair surface. Controller 34 regulates diesel powered generator 28 to deliver electrical power to infrared heater 38 via power cable 32 to deliver the identified heating power to heater 38.

In step 126, temperature sensors 58 measure temperature ($TEMP_H$) of infrared heater 38. In step 128, temperature sensors 58 measure temperature of the repair surface ($TEMP_S$).

In step 130, a query is made to determine if the temperature of the infrared heater ($TEMP_H$) and of the repair surface ($TEMP_S$) have reached user requirements provided in step 104. If yes, then the method proceeds to step 114 and the surface hardness is measured. If no, the method proceeds to step 124 and heat is delivered to the repair surface. A check is also made in step 130 that the temperature of the infrared heater ($TEMP_H$) is within a safe range (for example, between 600 and 1000 deg. F.). If the range is exceeded the controller 34 may perform an emergency shut-down of the system 2.

The Digital Display 62 may comprise a display. The term "display" refers to a portion of one or more screens used to display the output of a computer to a user. A display may be a single-screen display or a multi-screen display, referred to as a composite display. A composite display can encompass the touch sensitive display of one or more screens. A single physical screen can include multiple displays that are managed as separate logical displays. Thus, different content can be displayed on the separate displays although part of the same physical screen. A display may have the capability to record and/or print display presentations and display content, such as reports.

Communications means and protocols may include any known to those skilled in the art, to include cellular telephony, internet and other data network means such as satellite communications and local area networks. As examples, the cellular telephony can comprise a GSM, CDMA, FDMA and/or analog cellular telephony transceiver capable of supporting voice, multimedia and/or data transfers over a cellular network. Alternatively or in addition, other wireless communications means may comprise a Wi-Fi, BLUETOOTH™, WiMax, infrared, or other wireless communications link. Cellular telephony and the other wireless communications can each be associated with a shared or a dedicated antenna. Data input/output and associated ports may be included to support communications over wired networks or links, for example with other communication devices, server devices, and/or peripheral devices. Examples of input/output means include an Ethernet port, a Universal Serial Bus (USB) port, Institute of Electrical and Electronics Engineers (IEEE) 1394, or other interface. Communications between various components can be carried by one or more buses.

Computer processing may include any known to those skilled in the art, to include desktop personal computers, laptops, mainframe computers, mobile devices and other computational devices.

What is claimed is:

1. An asphalt roadway repair apparatus, comprising:

a heater configured to heat a roadway repair site to a selected temperature and a selected hardness, the heater interconnected to a roadway machine configured to position the heater proximate to the roadway repair site;

at least one heater temperature sensor disposed proximate to or on the heater;

at least one material hardness sensor disposed proximate to or on the heater and configured to measure subsurface hardness;

at least one heater orientation sensor disposed at least one of adjacent to or on the heater to identify an orientation of the heater with respect to a surface of the roadway;

a power unit in communication with the heater and adapted to provide energy to the heater; and a controller in communication with the power unit and adapted to receive control measurement inputs comprising a heater temperature measurement input from the heater temperature sensor, a heater orientation input from the at least one heater orientation sensor and a repair site material subsurface hardness measurement input from the at least one material hardness sensor;

wherein the controller automatically controls the heater orientation to maintain a heater orientation with respect to the surface of the roadway;

wherein the controller automatically controls the energy level of the power unit based on at least the subsurface hardness measurements received from the at least one material hardness sensor.

2. The apparatus of claim 1, further comprising a vertical position sensor positioned proximate to or on the heater.

3. The apparatus of claim 1, wherein the at least one material hardness sensor measures a penetration index.

4. The apparatus of claim 1, further comprising a user display, the display presenting the energy level of the power unit as determined by the controller.

5. The apparatus of claim 1, wherein the apparatus further comprises at least one actuator configured to adjust the heater orientation.

6. The apparatus of claim 1, further comprising a repair site ambient temperature sensor positioned proximate to or directly on the heater.

7. The apparatus of claim 1, wherein the at least one material hardness sensor is a penetrometer.

8. The apparatus of claim 1, wherein the at least one material hardness sensor is a plurality of penetrometers disposed on a lower surface of the heater.

9. The apparatus of claim 1, wherein the controller utilizes control algorithms comprising at least one of on/off control, a proportional control, a differential control, an integral control, a state estimation, an adaptive control and stochastic signal processing.

10. The apparatus system of claim 1, wherein the heater has sufficient perimeter dimension to heat an entire pothole surface area and at least 50% of the surrounding asphalt surface site.

11. A method for repair of a roadway surface, comprising the steps of:

positioning a heater proximate to a roadway repair site;

receiving, from at least one heater orientation sensor, an orientation of the heater with respect to a surface of the roadway;

automatically controlling, by a controller, the heater orientation to maintain a heater orientation with respect to the surface of the roadway;

measuring a repair site temperature and a repair site subsurface hardness;

determining a power level for the heater based on at least one of the repair site temperature and the repair site subsurface hardness;

activating the heater at the determined power level wherein heat from the heater is imparted to the repair site;

heating the repair site and automatically adjusting, by a controller, the determined power level until at least one of a selectable repair site temperature and repair site subsurface hardness is achieved;

providing an asphalt material and a conditioner;

conditioning an area surrounding the repair site by beveling an edge of the repair site to a predetermined angle;

inserting the asphalt material and the conditioner into the repair site; and compacting the asphalt material and the conditioner into the repair site.

12. The method of claim 11, wherein the heater is adapted to interconnect to a roadway machine configured to position the heater proximate to the roadway repair site.

13. The method of claim 11, wherein the repair site hardness is measured by at least one penetrometer.

14. The method of claim 11, wherein the heater orientation is adjusted by at least one actuator.

15. The method of claim 11, wherein the heater is activated by a power unit.

16. The method of claim 11, wherein the repair site hardness is measured by a plurality of penetrometers disposed on a lower surface of the heater.

17. The method of claim 11, wherein the roadway repair site is an asphalt roadway repair site.

18. An asphalt roadway repair system, comprising:

a heater configured to heat an asphalt repair site of a roadway surface to a predetermined temperature and a predetermined hardness, the heater adapted to interconnect to an apparatus configured to position the heater in a preferred orientation substantially parallel to the asphalt repair site;

at least one heater temperature sensor disposed proximate to the heater;

at least one material hardness sensor disposed proximate to the heater and configured to measure subsurface hardness;

a power unit in communication with the heater and configured to provide a power level to the heater; and a controller in communication with the power unit and adapted to receive control measurement inputs comprising a heater temperature measurement input from the heater temperature sensor and a repair site material hardness measurement input from the material hardness sensor;

wherein the controller automatically controls the power level of the power unit based on at least the subsurface hardness measurements received from the at least one material hardness sensor.

19. The system of claim 18, further comprising a vertical position sensor disposed proximate to the heater.

20. The system of claim 18, wherein the at least one material hardness sensor is a penetrometer that measures a penetration index.

* * * * *